US006032372A

United States Patent [19]

Dischler

[11] Patent Number: 6,032,372

[45] **Date of Patent: *Mar. 7, 2000**

[54] INTRINSICALLY FENCED SAFETY RAZOR HEAD

[76] Inventor: Louis Dischler, 252 W. Park Dr., Spartanburg, S.C. 29306-5013

[ * ] Notice: This patent is subject to a terminal disclaimer.

[21] Appl. No.: 09/102,138

[22] Filed: Jun. 22, 1998

[51] Int. Cl.[7] ..... B26B 21/20; B26B 21/56

[52] U.S. Cl. ..... 30/346.57; 30/50; 30/346.55

[58] Field of Search ..... 30/346.57, 346.5, 30/346.56, 346.55, 47–50, 346.61

[56] References Cited

U.S. PATENT DOCUMENTS

| | | | |
|---|---|---|---|
| 228,829 | 6/1880 | Moody . | |
| 1,035,548 | 8/1912 | Dickenson . | |
| 1,241,921 | 10/1917 | Carroll . | |
| 1,387,465 | 8/1921 | Browning . | |
| 1,506,533 | 8/1924 | Klecka . | |
| 1,589,826 | 6/1926 | Strand . | |
| 2,043,998 | 6/1936 | Hadjopoulos | 30/48 |
| 2,126,728 | 8/1938 | Buell | 30/48 |
| 2,517,028 | 8/1950 | Ridner . | |
| 2,614,321 | 10/1952 | Ackerman . | |
| 2,794,252 | 6/1957 | Plesch . | |
| 3,263,330 | 8/1966 | Ferrara . | |
| 3,505,734 | 4/1970 | Iten . | |
| 3,750,285 | 8/1973 | Michelson . | |
| 3,783,510 | 1/1974 | Dawidowicz et al. . | |
| 3,964,160 | 6/1976 | Gordon . | |
| 4,211,006 | 7/1980 | Halaby et al. . | |
| 4,247,982 | 2/1981 | Booth et al. . | |
| 4,252,837 | 2/1981 | Auton . | |
| 4,265,015 | 5/1981 | Asano . | |
| 4,590,674 | 5/1986 | Harper . | |
| 4,603,477 | 8/1986 | Francis . | |
| 4,663,843 | 5/1987 | Savage . | |
| 4,720,917 | 1/1988 | Solow | 30/49 |
| 4,791,724 | 12/1988 | Dumas . | |
| 4,914,817 | 4/1990 | Galligan et al. . | |
| 5,018,274 | 5/1991 | Trotta . | |
| 5,031,316 | 7/1991 | Oldroyd | 30/47 |
| 5,048,191 | 9/1991 | Hahn . | |
| 5,153,992 | 10/1992 | Brown . | |
| 5,199,173 | 4/1993 | Hegemann et al. | 30/531 X |
| 5,305,526 | 4/1994 | Althaus . | |
| 5,501,014 | 3/1996 | Hegemann . | |
| 5,526,568 | 6/1996 | Copeland . | |
| 5,630,275 | 5/1997 | Wexler . | |
| 5,661,907 | 9/1997 | Apprille, Jr. . | |
| 5,689,883 | 11/1997 | Ortiz et al. | 30/50 X |

*Primary Examiner*—Douglas D. Watts

[57] ABSTRACT

The various embodiments of the invention are directed to safety razor heads (1) having an intrinsically fenced unitary blade (7) oriented at a high slicing angle to the shaving direction. The unitary blade comprises a plurality of short blade edges (22) in a spaced relationship across the width of the blade, bounded by leading (19) and trailing guards (8), and oriented at an angle greater than 30 degrees, resulting in enhanced cutting action, improved lubricant and debris flow, and longer life. A method of assembling the cutting edges into unitary form is provided.

7 Claims, 8 Drawing Sheets

INTRINSICALLY FENCED SAFETY RAZOR HEAD

FIELD OF THE INVENTION

This invention relates to safety razors of the type that have a plurality of adjacently mounted blades permanently mounted in the razor head. More particularly, this invention relates to razor heads having a plurality of short blades having intrinsic fencing, mounted at a high slicing angle.

BACKGROUND OF THE INVENTION

The advantages of using blades with a slicing rather than chopping motion have been known for hundreds, perhaps thousands of years. One has but to cut a loaf of bread to immediately realize that a slicing motion cuts cleaner and with less tearing. The most immediate advantage for the blade is the reduction of force that is required for cutting, reducing wear and tear on the on the cutting edge. For a shaver, it is perhaps more important that the cutting force applied to the follicles be reduced, producing a less painful shaving experience. While it has been possible for the shaver to use straight razors, as well as disposable razor cartridges. in such a way as to create an oblique or slicing angle, this has always been hazardous as the blade that easily slices follicles also easily slices the epidermis. Several patents have resulted from attempts to safely apply the advantages of a slicing angle to shaving. Gordon, (U.S. Pat. No. 3,964,160) and Copelan, (U.S. Pat. No. 5,526,568) patented razors which made manual oblique shaving easier, that is, the wrist did not have to be held at an awkward angle to maintain the slicing angle, but both lacked the concomitant stability of a razor head perpendicularly oriented to the shaving direction. Copeland teaches that, to obtain the advantages of oblique shaving while avoiding cutting of the skin, the oblique angle of a useable razor head should be restricted to between 10 and 26 degrees, and preferably to an angle of 18 degrees. Razors featuring adjustable slicing angles, such as Gordon's, have had an additional disadvantage, since the geometry of the razor head must be carefully balanced, and is unlikely to be optimum for variable slicing angles. Others have patented a variety of oblique arrangements, wherein a pair of blades are oriented in a "V" arrangement. Carroll (U.S. Pat. No. 1,241,921), Moody (U.S. Pat. No. 228,829), and Browning (U.S. Pat. No. 1,387,465) are typical of this approach, which suffers from excess stability. Because of the large footprint created by the two legs of the cutting zone, such a razor head has great difficulty in handling variations in facial geometry; a difficulty which only increases as the slicing angle, is increased. Savage (U.S. Pat. No. 4,663,843) patented a razor head using a conventional blade in tandem with blades angled at a slicing angle. He teaches that the slicing angle should lie between 15 and 30 degrees, in order to have some of the advantages of oblique cutting, while avoiding cutting of the skin. Savage does not appreciate the advantages arising from the use of intrinsic fencing, which would not only allow shaving at much higher slicing angles, but also make a tandem conventional blade unnecessary.

Fencing of razor blades is known. Dickenson (U.S. Pat. No. 1,035,548) teaches the use of wire wrapping of the blade edges, an approach that has been used by several others, such as Item (U.S. Pat. No. 3,505,734), and Michelson (U.S. Pat. No. 3,750,285). Similarly, Ferrara (U.S. Pat. No. 3,263, 330) discloses a fencing arrangement wherein the blade edge is wrapped with a flexible perforated sheet, and Auton (U.S. Pat. No. 4,252,837) patented a blade fenced with a vacuum deposited intermittent coating. Galligan et al. (U.S. Pat. No. 4,914,817) teaches the use of tape having parallel riblets covering parts of the blade edges. None have previously appreciated the advantages accruing from intrinsically fenced blades.

Foil blades are known. Ackerman (U.S. Pat. No. 2,794, 252) patented a perforated foil blade arrangement claimed to enable omni-directional shaving. Brown (U.S. Pat. No. 5,153,992) patented a perforated blade wherein shaving could be accomplished with a "scrubbing action". Perforated blades do not benefit from the advantages inherent in a single high slicing angle.

Ceramic blades are also known. Hahn (U.S. Pat. No. 5,048,191) teaches the production of ceramic blades using abrasive and sputtering steps, while Trotta (U.S. Pat. No. 5,018,274) patented a razor head produced from a obliquely sliced ceramic billet containing rectangular cells. The Trotta approach requires a considerable amount of polishing of small cut parts.

OBJECTS AND ADVANTAGES

Accordingly, I claim the following as objects and advantages of the invention: to provide a razor head having intrinsically fenced cutting means oriented at a high shearing angle which is capable of producing a smooth, safe shave with reduced pulling of follicles, to enhance the life of razor cutting means, to provide a clean trim line, to improve skin support and flow during shaving, to provide channels for improved flow of shaving debris, to provide improved interaction of shaving lubricant with the cutting edges, and to provide a unitary blade construction.

Further objects and advantages will become readily apparent as the specification proceeds to describe the invention with reference to the accompanying drawings.

BRIEF DESCRIPTION OF THE DRAWINGS

The above as well as other objects of the invention will become more apparent from the following detailed description of the preferred embodiment of the invention, when taken together with the accompanying drawings in which.

DRAWING REFERENCE NUMERALS

Figure 1:
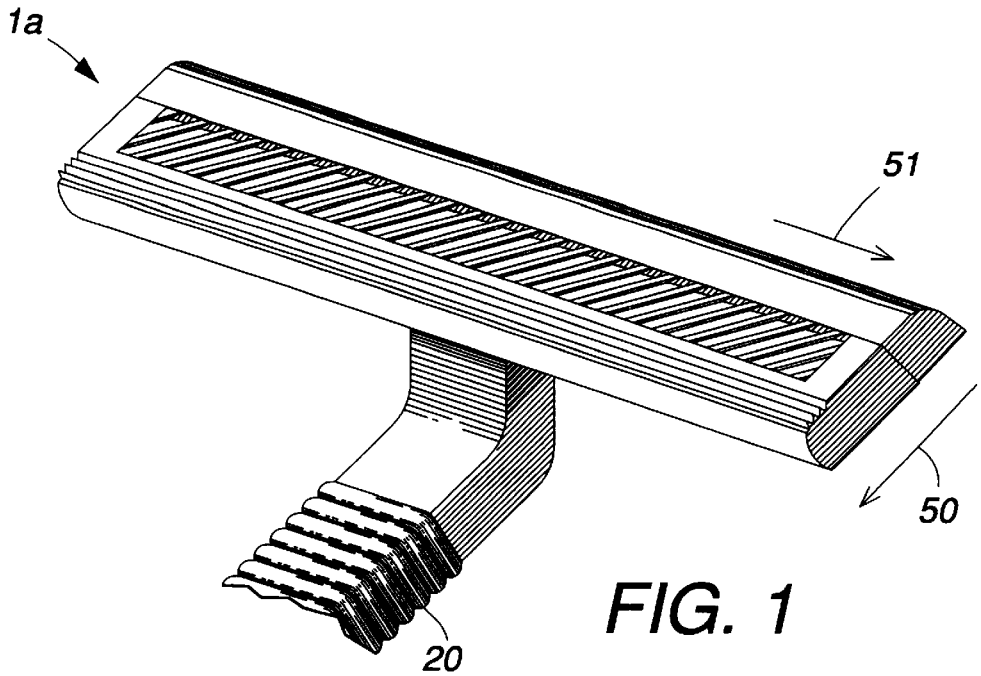
FIG. 1 is a perspective view of an assembled razor head with unitary blade means, according to the invention.

| | |
|---|---|
| 1 | razor head |
| 2 | blade base |
| 3 | cap |
| 4 | right flanking guard |
| 5 | blade platform |
| 7 | unitary blade |
| 8 | trailing guard |
| 9 | left flanking guard |
| 10 | right locating post |
| 12 | left locating post |
| 13 | recess |
| 16 | skin tensioning means |
| 18 | blade land |
| 19 | leading guard |
| 20 | handle |
| 21 | unitary blade base |
| 22 | cutting edge |
| 23 | blade |
| 24 | flat top |
| 25 | unground face |
| 28 | acute wall |
| 29 | vertical wall |
| 30 | oblique wall |
| 31 | flow channel |
| 32 | unitary billet |
| 34 | corner |
| 36 | corner |
| 38 | channel floor |
| 40 | projection |
| 42 | fenced unitary blade billet |
| 44 | fenced unitary blade |
| 46 | composite unitary blade |
| 48 | composite unitary blade |
| 50 | shaving direction |
| 51 | trim direction |
| 52 | blade base |
| 53 | blades |
| 54 | blades |
| 56 | gap |
| 57 | unitary blade |
| 60 | parallelogram form |
| 61 | parallelogram form |
| 62 | guard wedge |
| 63 | base |
| 64 | blade segment |
| 66 | perforation |
| 68 | blade support |
| 70 | lower leg |
| 72 | leg angle |

-continued

| | |
|---|---|
| 74 | upper leg |
| 76 | slot |
| 77 | unitary foil blade |
| 78 | raised slot edge |
| 79 | locating slot |
| 80 | individual blade |
| 81 | cut line |
| 82 | blade slot |
| 84 | blade strip |
| 85 | strip surface |
| 86 | score line |
| 88 | cutting line |
| 90 | shaving angle |
| 92 | leading flat |
| 93 | trailing flat |
| 94 | angle |

DETAILED DESCRIPTION OF THE INVENTION

Specific terms are used as follows: "Shaving plane" means the ideally flat skin surface to be shaved. "Safety razor" means a razor having a leading guard, which is typically used with a lather or cream. "Razor head" is meant to include both razor cartridges adapted for use with a separate handle, as well as the upper, operative elements of a disposable razor with a permanently attached handle. "Shaving direction" signifies the direction in the shaving plane in which the razor head is intended to be moved. "Trim direction" signifies the direction in the shaving plane generally perpendicular to the shaving direction, that is, the direction taken when the razor head is moved sideways. "Cutting zone" refers to that area of the razor head containing blades, which is designed to cut follicles. The cutting zone has a width, which is generally perpendicular to the shaving direction, and a height considerably shorter than the width. "Span" means the distance between two adjacent edges in the cutting zone, measured in the shaving direction. "Leading span" means the span between the loading guard and the first encountered blade edge. "Trailing span" means the span between the trailing guard and the immediately preceding blade edge, while "intermediate span" means the span between two adjacent cutting edges. "Blade spacing" refers to the distance between two adjacent cutting edges measured in the direction perpendicular to the shaving direction. "Fencing" refers to any method of intermittently and positively breaking the contact of a blade edge with the skin, so that a long blade edge is effectively broken up into a series of shorter blade edges. "Effective cutting length" means the uninterrupted cutting edge, bounded by guards or fencing elements, which can contact the skin. "Shaving angle" is the angle the blades make relative to the shaving plane. "Slicing angle" is the angle in the shaving plane that the blade edges make relative to the trim direction. "Trim angle" is the angle in the shaving plane that the blade edges make relative to the shaving direction. "Guard" refers to one of the generally peripheral ridges that control the contact of the razor edges with the skin. "Leading guard" means the guard extending along the width of the cutting zone, which contacts the skin prior to the blades. "Trailing guard" means the guard extending along the width of the cutting zone, which contacts the skin subsequent to the blades, and "flanking guard" means either one of the two guards that keep the skin from contacting the cut edges of the blades along the height of the cutting zone. "Unitary blade" refers to a structure containing a plurality of blades oriented in a fixed spaced relationship. A unitary blade may be of the monolithic, composite, or foil types.

PRINCIPLE OF THE INVENTION

The genesis of this invention began with the observation that fencing was effective even at high slicing angles, coupled with the realization that short sections of blades, bounded by leading and trailing guards, were functionally superior to single short blade segments between fencing elements.

An investigation was conducted to examine the relationship of slicing angle to perceived roughness, as it was expected that the sensation of roughness, as it reflects the tendency of the cutting edge to grab and release small protrusions on the surface, would provide a measure of the tendency of the blade to cut into the epidermis. A randomly textured rubber surface was used to simulate rough skin. A razor blade edge, oriented at a 90 degree shaving angle in order to eliminate the propensity to cut into the simulated skin, was loaded to simulate a light shaving pressure, and was pulled across the surface at various slicing angles. A measure of the subjective sensation of roughness was then created by force ranking the trial results obtained with a full width blade using slicing angles from 0 to 80 degrees, at 10-degree increments. This ranking runs from 1 to 9, with larger numbers indicating increasing roughness. The results appear in the column for the 39-mm length in the table below. The perceived roughness tended to increase steadily from 0 degrees to 80 degrees, with a small dip occurring at 10 degrees. The effective blade width was then reduced by partially covering the blade edge with thin metal tape. The trial was then repeated as before, this time rating the perceived roughness relative to the 9 level scale developed using the full width (39 mm) blade.

As the effective blade length was incrementally reduced, an unexpected inversion of the trend to increasing roughness was observed to occur at lengths of 8 mm and below, which is contrary to the teachings of others versed in the art. At 8 mm, the inversion occurs at 40 to 50 degrees, and at 6.5 and 4.5 mm, the inversion occurs at 30 degrees. The inversion is more pronounced at 6.5 mm and below, where the perceived roughness plummets to the lowest levels on the scale. Surprisingly, the best results were obtained at angles greater than 50 degrees. To check the effect of the total exposed blade length, another test was run with a blade fenced in 2 places to provide three lengths of exposed blade, each 4.5 mm long, which produced almost identical results to that tabulated for a single 4.5 mm section in the table below, indicating that this discovered effect is not due to a reduction in the total length of the exposed blade.

TABLE

| | | Length of exposed blade edge (mm) | | | | | |
|---|---|---|---|---|---|---|---|
| | | 39 | 11 | 9.5 | 8 | 6.5 | 4.5 |
| Slicing angle (degrees) | 0 | 3 | 2 | 3 | 2 | 2 | 3 |
| | 10 | 1 | 1 | 1 | 1 | 1 | 1 |
| | 20 | 2 | 2 | 2 | 2 | 3 | 2 |
| | 30 | 4 | 3 | 2 | 2 | 4 | 3 |
| | 40 | 5 | 4 | 2 | 3 | 3 | 2 |
| | 50 | 6 | 4 | 3 | 3 | 2 | 2 |
| | 60 | 7 | 4 | 5 | 2 | 1 | 1 |
| | 70 | 8 | 5 | 5 | 2 | 1 | 1 |
| | 80 | 9 | 6 | 5 | 2 | 1 | 1 |

Shaving tests were performed using a conventional two-blade cartridge razor fenced to provide multiple exposed blade lengths corresponding to the blade lengths used in the Table above. It was found that exposed blade lengths of 9.5 mm and greater tended to cut the skin at slicing angles above 30 degrees. Using an exposed blade length of 8 mm produced a smooth shave at various shearing angles up to 85 degrees, with no noticeable cutting. However, several hours later, some reddening was observed, indicating that cutting of the epidermis did occur. For exposed lengths of 6.5 mm and below, no cutting or delayed skin response was observed at any slicing angle. Pulling of follicles during shaving was noticeably reduced at angles greater than 30 degrees, and this was particularly noticeable at angles greater than 45 degrees. Subsequent tests were performed using nine short blades arranged in a staggered relationship, and guarded with leading and trailing guards. Using blade lengths of 6.5 mm, and a slicing angle of 45 degrees, it was apparent that the same benefits of enhanced follicle cutting resulted, while at the same time epidermal damage was avoided, as was predicted from the previous tests. This general arrangement of short blades with leading and trailing guards at a high slicing angle is herein referred to as "intrinsic fencing". The "high slicing angle" should be more than 30 degrees, preferably at least 45 degrees and most preferably at least 50 degrees. To control the flow of skin so that contact with the blades is limited to the effective blade length, the leading and trailing guards should rise approximately to the level of the cutting edges. The guards may also rise above this level, reducing the effective blade length, and may comprise skin tensioning means. Intrinsic fencing is superior to wire or thread fencing, which can break or become dislodged during use. and can trap or impede shaving debris.

For razor heads employing cutting edges at a slicing angle, skin flow control using short blade segments between leading and trailing guards is superior to that obtained by point fencing of the blades, such as that obtained by forming deposits on the blade edge. With leading and trailing guards, the skin is supported in the blade direction by the several blades, and also in the guard direction, while the skin can bulge further into the spaces between the blades when point fencing is used.

The arrangement of blades in the instant invention produces a variable span—a leading span which ranges from zero to the intermediate span, which is constant, and a trailing span, which ranges from the intermediate span to zero. To control the intermediate span so as to produce a smooth and continuous shave, the blade spacing should not exceed the effective blade length multiplied by the cosine of the slicing angle. Also, it is believed that the minimum effective blade length is about 1 mm, in order to provide sufficient cutting action.

In order to produce a clean trim line, the shaver may move the razor head of the instant invention against the skin in the trim direction. If, for instance, the blades are set at a slicing angle of 45 degrees, then the trim angle is also 45 degrees. As the slicing and trim direction are orthogonal, the slicing angle plus the trim angle equal 90 degrees. Trimming a clean line next to a mustache can be accomplished by moving the razor head down the face to the edge of the mustache, then moving the razor head sideways along the edge of the mustache. When moved sideways, the cutting means are arranged one behind the other. This not only produces a sharp trim line, but cuts the follicles many times over in one pass, so as to produce an unusually close shave. The razor head of the instant invention thus has two modes of operation, shaving and trimming, which in general can be accomplished without twisting the razor head or the wrist, but is accomplished simply by changing the direction of the stroke. If the razor head of the instant invention has bidirectional cutting means so as to allow shaving in both the forward and reverse shaving direction, then trimming may also be accomplished in the forward and reverse trim directions.

MONOLITHIC UNITARY BLADES

Figure 2:
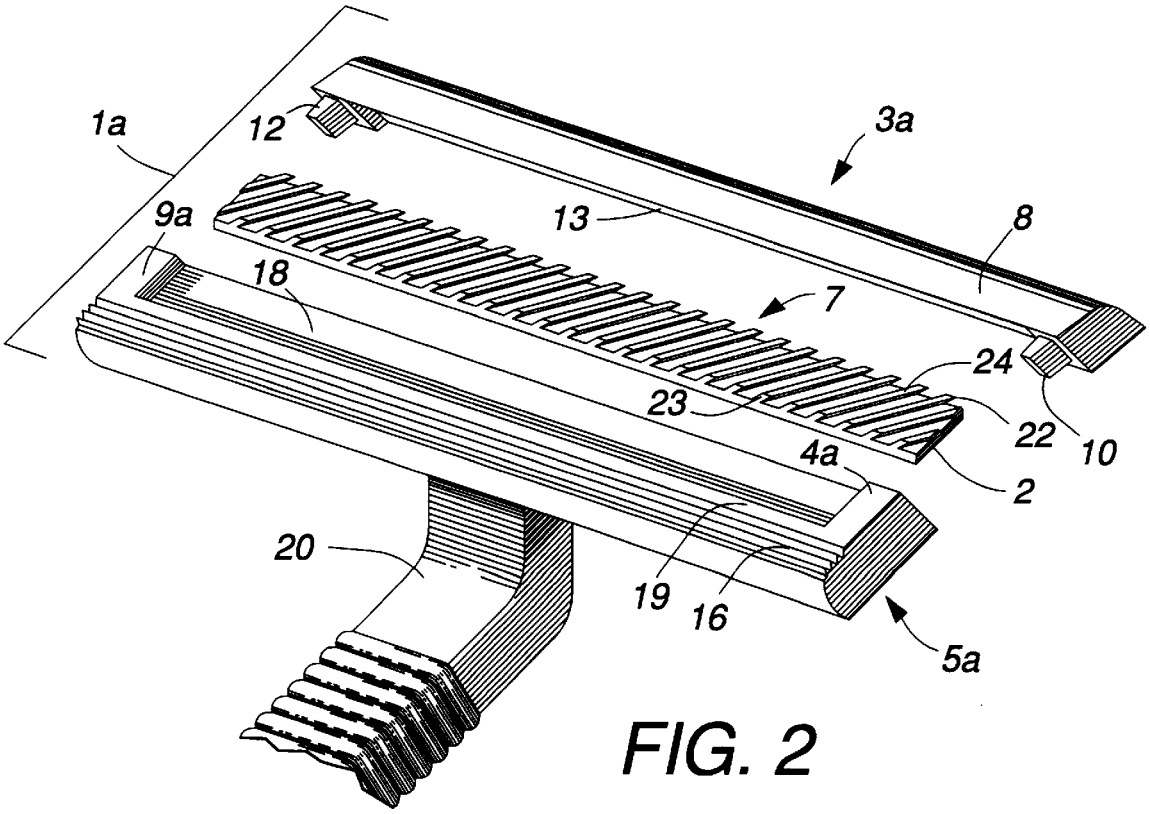
FIG. 2 is an exploded perspective view of the razor head assembly of FIG. 1.

While it is possible to construct a self-fenced blade arrangement using separate blade segments, it is preferable to employ a unitary blade, with each of the blade edges fixed in the proper relationship to its neighboring blade edges, so as to simplify the assembly of the razor head, and to insure that the placement of the blade edges relative to one another does not change. One embodiment of the invention wherein the cutting means are monolithic is illustrated in FIG. 1, where the assembled razor head 1*a* is mounted to a handle 20. The shaving direction is indicated by the arrow 50, and the trim direction is indicated by the arrow 51. In FIG. 2, the razor head 1*a* is shown to comprise a blade platform 5*a*, a unitary blade 7, and a cap 3*a*. The blade platform 5*a* further comprises a blade land 18 for locating the unitary blade, a leading guard 19 rising up to or slightly above the level of the cutting edges 22 of the unitary blade 7 when assembled, and having skin tensioning means 16, a left flanking guard 9*a*, and a right flanking guard 4*a*. The unitary blade 7 comprises a blade base 2, from which project a plurality of blades 23, which have a substantially flat top 24, and a cutting edge 22. The cap 3*a*, comprises left and right locating posts, 12 and 10, which enter into matching receiving notches (not shown) in the blade platform 5*a*. The cap 3*a* has a trailing guard 8, which rises up to or slightly above the top of the unitary blade 7, when assembled. The recess 13 allows passage of shaving debris channeled between the blades 23, to exit the cutting zone, which comprises the top surface of the unitary blade 7.

Figure 3:
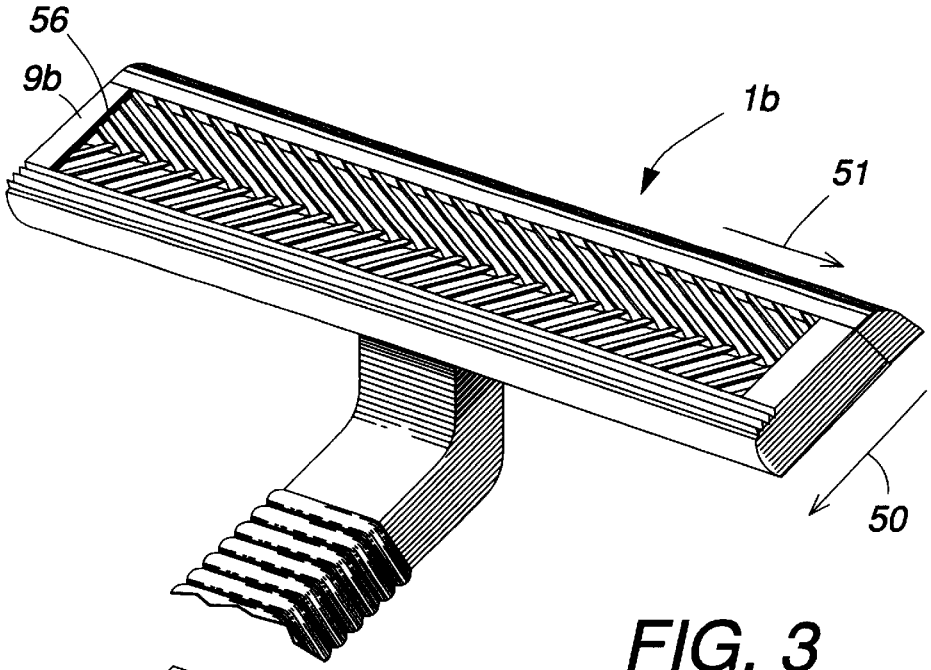
FIG. 3 is a perspective view of an assembled razor head of an alternative embodiment of the invention, with two sets of unitary blade means with opposing slicing angles.
Figure 4:
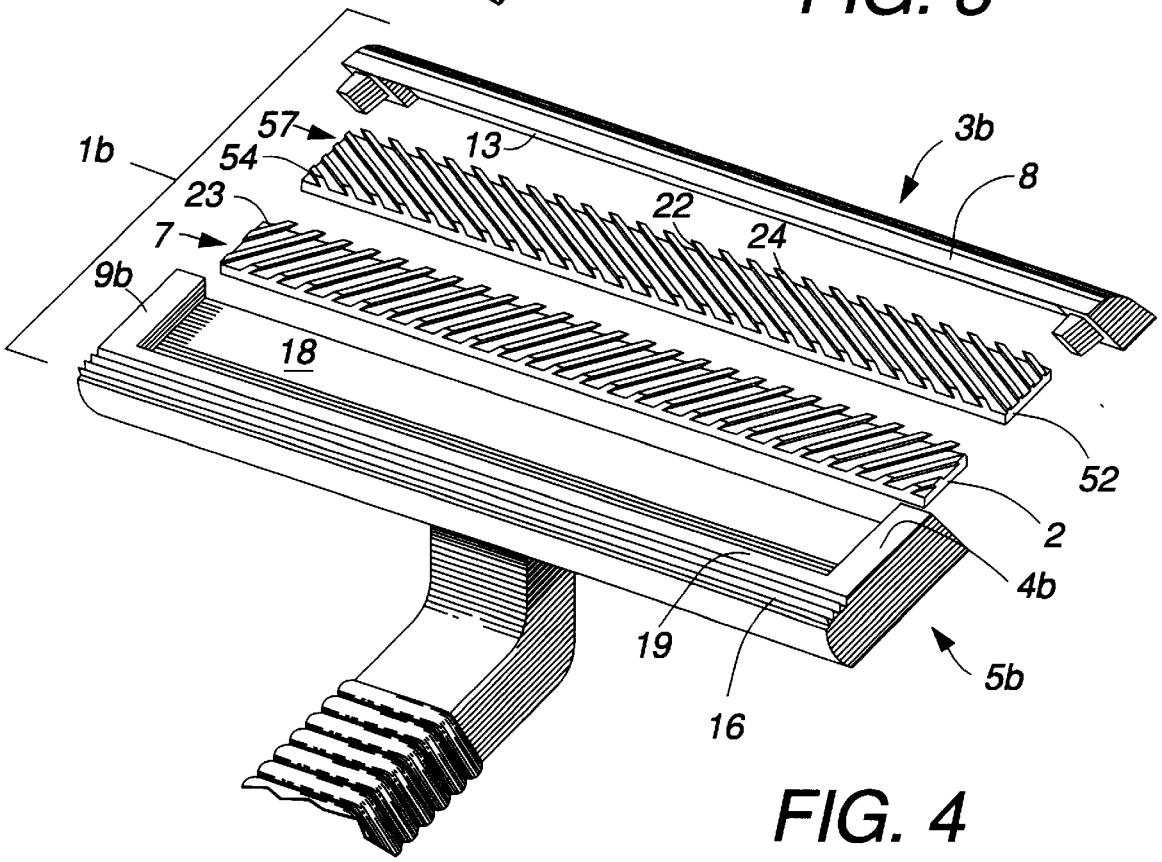
FIG. 4 is an exploded view of the FIG. 3 razor head assembly.

In another embodiment of the invention, more than one monolithic blade means may be employed to increase the size of the cutting zone, and to cut follicles with both left handed and right handed blade means, so as to maximize the potential for closely cutting every follicle in one pass of the razor head. In FIG. 3, the razor head is generally indicated by numeral 1*b*, the shaving direction is again indicated by the arrow 50, and the trim direction by the arrow 51. In FIG. 4, the razor head 1*b* is shown to comprise the same general elements as shown in FIG. 2, with the addition of a second unitary blade 57, subsequent to the first unitary blade 7. The unitary blade 57 has the same blade spacing, but the opposite hand of the unitary blade 7, while the cutting length of the blades 54 may be different from that of the blades 23. The unitary blade 57 comprises a blade base 52, from which project a plurality of blades 54, which have a substantially flat top 24, and a cutting edge 22. The blades 23, 54 are aligned so that shaving debris may pass continuously down the channels formed between the adjacent blades 23 of the cutting zone of the first blade 7 into the channels formed by adjacent blades 54 of the second unitary blade 57, and thence into the recess 13, which opens to the back of the razor head 1*b*. In order that the channels of the blade 7 match with the channels of the blade 57, the blade spacing of each should be the same, although the slicing angles may differ. A gap 56, shown in FIG. 3, may be provided to allow shaving debris to exit channels that intersect a flanking guard 9*b*. The unitary blades may be fixed to the blade land 18, shown in FIG. 4, by means of an adhesive applied to the interface or, as one alternative, the unitary blades may be captured by means of an interference fit with the flanking guards 4*b* and 9*b*, or by means of an interference fit with the leading guard 19 and trailing guard 8.

Figure 5:
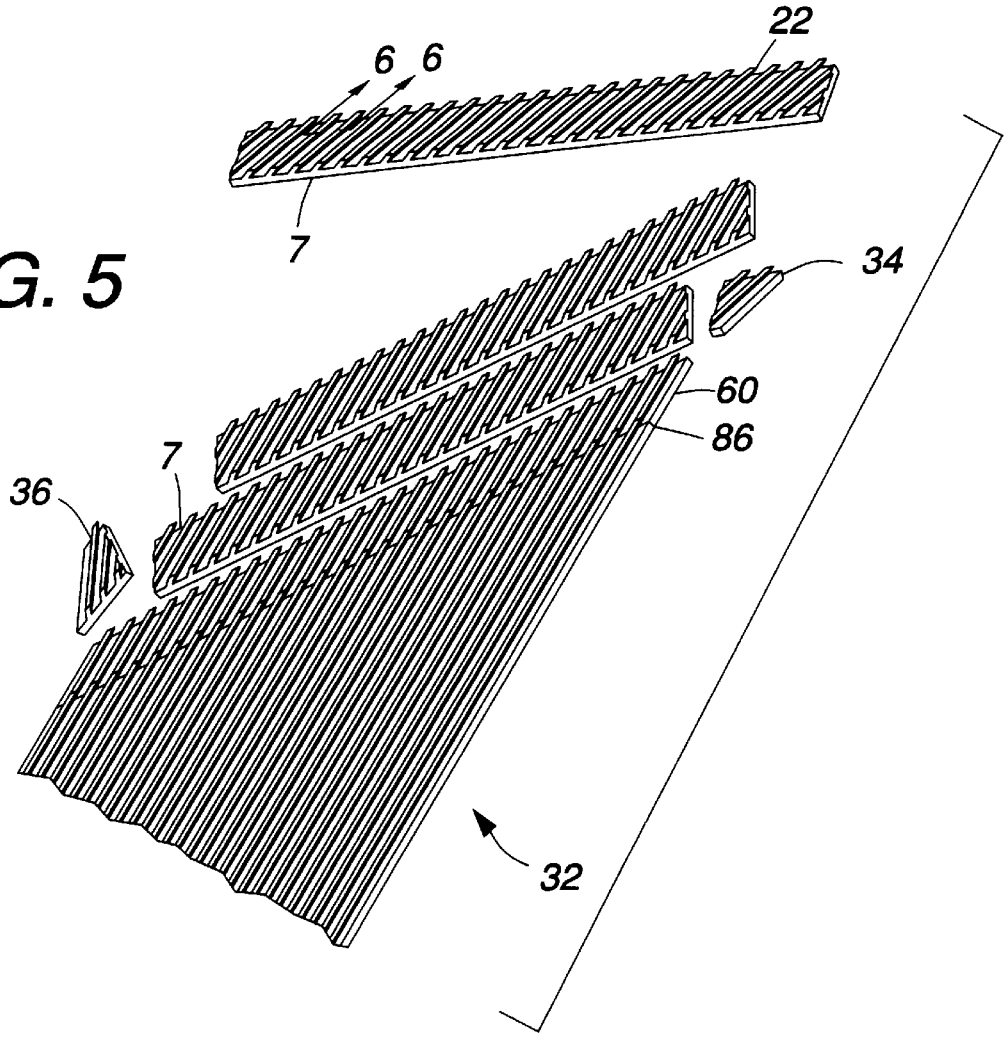
FIG. 5 is a perspective view of a unitary blade billet being cut into unitary blades with high slicing angles, according to the invention.

The unitary blades 7, 57 may be manufactured from an extruded ceramic billet 32, shown in FIG. 5. After extrusion to a near net shape, the cutting surface is ground to produce the cutting edges, and the billet is heat treated to produce the required hardness, followed by an optional polishing step. By extruding to near net shape, a minimum of grinding or polishing need be done to create the cutting edges. The next step in the preparation of the unitary blade is to divide the billet diagonally across the width at an angle to the long direction of the billet equal to the slicing angle. This may be accomplished by abrasive cutting, or by snapping along a score line 86. The unitary blade may be used in this parallelogram form 60, or the width may be trimmed to remove the comers 34, 36 to produce a rectangular form 7. By sectioning the billet 32 after the cutting edges 22 have been prepared, handling and polishing of small parts is minimized.

Figure 6:
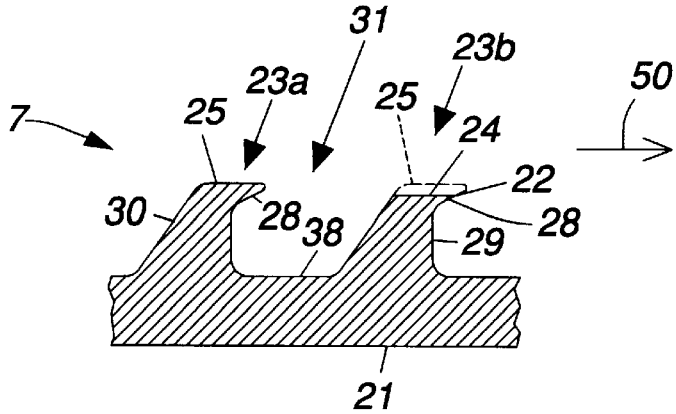
FIG. 6 is a sectional view taken along 6—6 of FIG. 5.

In FIG. 6, a partial cross-section of the unitary blade 7 is shown, which comprises blades 23*a* and 23*b*, and unitary blade base 21. For purposes of illustration, the blade 23*a* is shown in the near net extruded shape, prior to grinding, and the blade 23*b* is shown subsequent to grinding. The unground face 25 has been removed by the grinding step, forming the cutting edge 22 at the intersection of the flat top 24 and the acute wall 28. Variation in the depth of grinding will not influence the angular geometry of the cutting edges 22 so long as the plane of the flat top 24 intersects within the blade 23*b* anywhere with the acute wall 28. The blades additionally comprise an oblique wall 30, and a vertical wall 29. A land 38 separates the adjacent blades 23*a*, 23*b*. The flow channel 31 defined by the walls 28, 29, 30 and the land 38, channels shaving debris down the unitary blade 7 and allows shaving lubricant to similarly flow down the blade, where it can continue to lubricate the skin, instead of being removed immediately, as with conventional blade heads.

Figure 8:
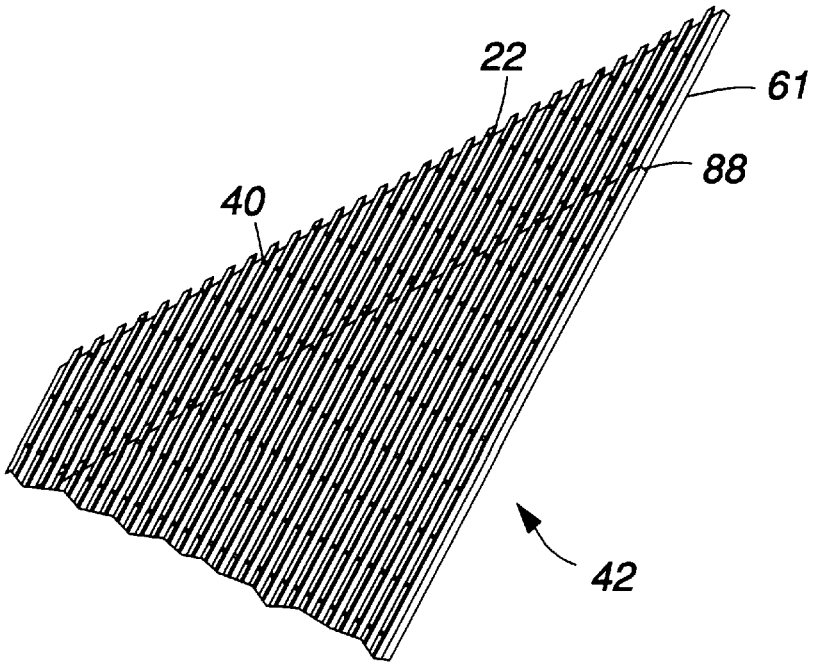
FIG. 8 is a perspective view of a unitary blade billet being cut into unitary blades billet having fence ridges, according to another embodiment of the invention.

In another embodiment of the unitary construction, the billet 32, in FIG. 5, and 42, in FIG. 8, may be extruded of a relatively soft metal such as aluminum, magnesium, zinc, copper, tin or alloys thereof. It is believed that because of the reduced cutting pressures associated with high shear angles, the billet 32, 42 may even be extruded of a polymeric or resinous material. After milling, burnishing, or polishing the face to obtain sharp edges, a hard overlay may be bonded to the face of the billet for durability, corrosion resistance, and lubricity. Appropriate materials for hard facing would include stainless steel, chromium, titanium, metal oxides, nitrides, carbides, borides, mixtures of a metal carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon alloys, fluorotelomer, polytetrafluorethylene, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, tungsten, hafnium/diamondlike carbon, niobium/diamond-like carbon, molybdenum/diamond-like carbon, vanadium/diamond-like carbon, silicon/diamond-like carbon, tantalum/diamond-like carbon, silicon carbide/diamond-like carbon, or mixtures thereof.

Figure 7:
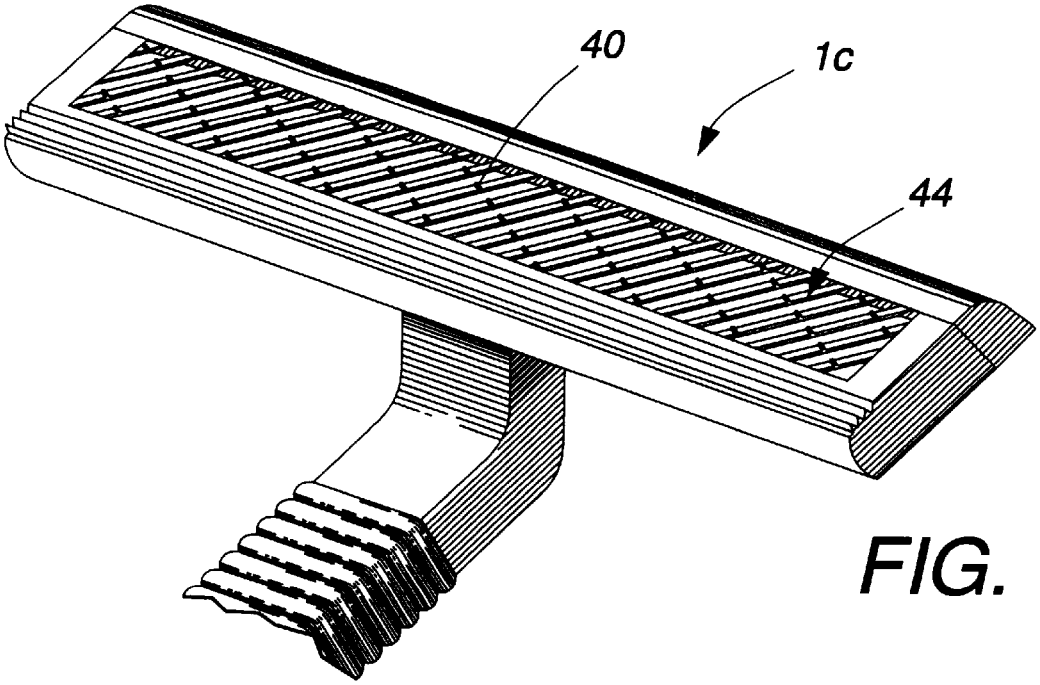
FIG. 7 is a perspective view of an assembled razor head of an alternative embodiment of the invention, with fenced blade means set at a high slicing angle.

The size of the cutting zone may be increased by employing extrinsic fencing, that is, actually breaking up the blade edge with projections. In FIG. 7, the razor head 1*c* comprises an extrinsically fenced unitary blade 44, comprising projections 40. In FIG. 8, a unitary blade billet 42 is illustrated. Unitary blades may be divided from the billet 42 along cutting line 88 to form a parallelogram form 61, which may be further trimmed into a rectangular shape. By grinding the face of billet 42 in a segmented fashion, raised projections 40 may be allowed to remain, thereby limiting the maximum effective cutting length to the distance between two adjacent projections 40 on a cutting edge 22.

COMPOSITE UNITARY BLADES

Figure 9:
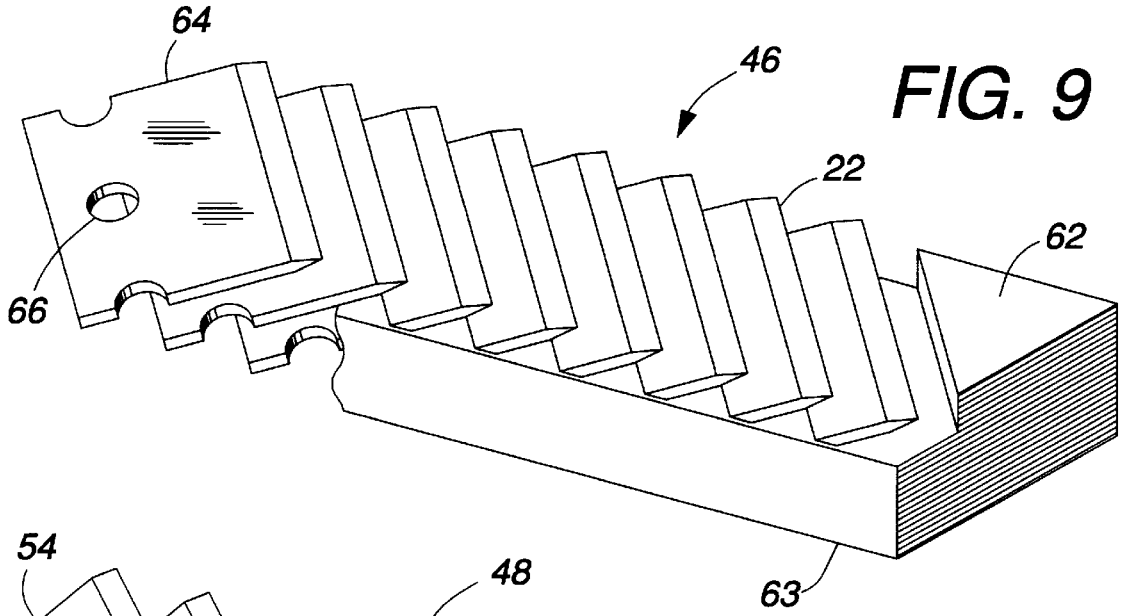
FIG. 9 is a partial perspective view of a composite unitary blade, according to the invention.

In another embodiment of the instant invention, strip blades may be bonded into a fixed position using the process of insert injection molding, pultrusion, welding, or by the use of adhesives, to fix the blades into a permanent geometrical relationship. An individual blade insert may be created, or preferably, a billet which is thereafter cut along a diagonal as in the case of the unitary construction. It is preferred that the blades are perforated so as to allow them to be mechanically locked in place. A composite unitary blade 46 is illustrated in FIG. 9, which comprises blades 64 with cutting edges 22, bonded in a spaced relationship in a base 63 which has a triangular guard wedge 62 to avoid the use of short. difficult to handle blades. The blades 64 have perforations 66 in order to aid in mechanically trapping the blades 64 into the base 63.

Figure 10:
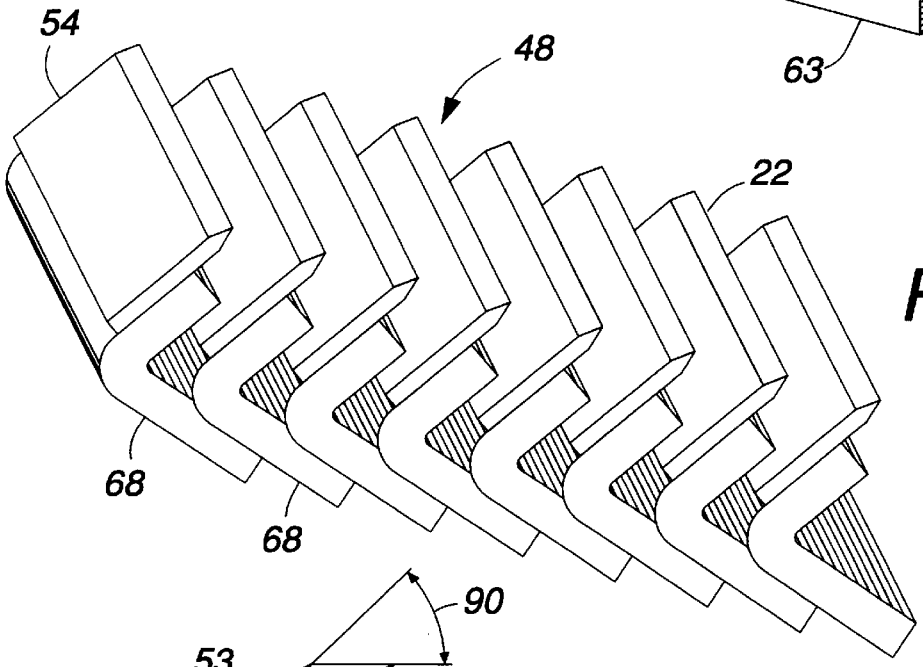
FIG. 10 is a partial perspective view of another composite unitary blade.
Figure 11A:
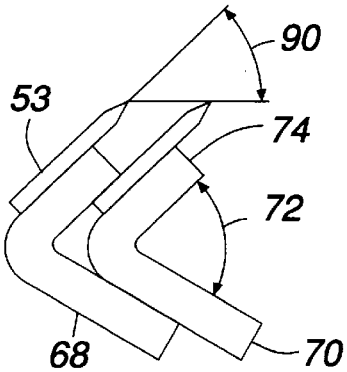
FIG. 11A is a side view of two adjacent blades in FIG. 10.
Figure 11B:
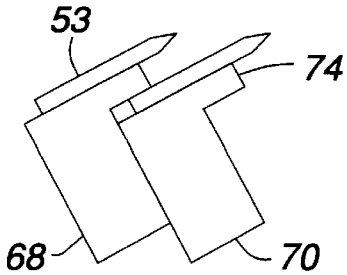
FIG. 11B is a side view of an alternative embodiment of the two adjacent blades shown in FIG. 11A.

Another embodiment of the composite unitary blades is illustrated in FIG. 10, wherein the composite unitary blade, generally indicated by the numeral 48, comprises blades 53, individually bonded to blade supports 68, which are in turn bonded to adjacent blade supports 68. Bonding may be adhesive, or by means of welding. As shown in FIGS. 11A and 11B, the shaving angle 90 is related to the thickness of the blade 53, the upper leg 74 and lower leg 70 of the blade support 68, and the leg angle 72.

FOIL UNITARY BLADES

Figure 12:
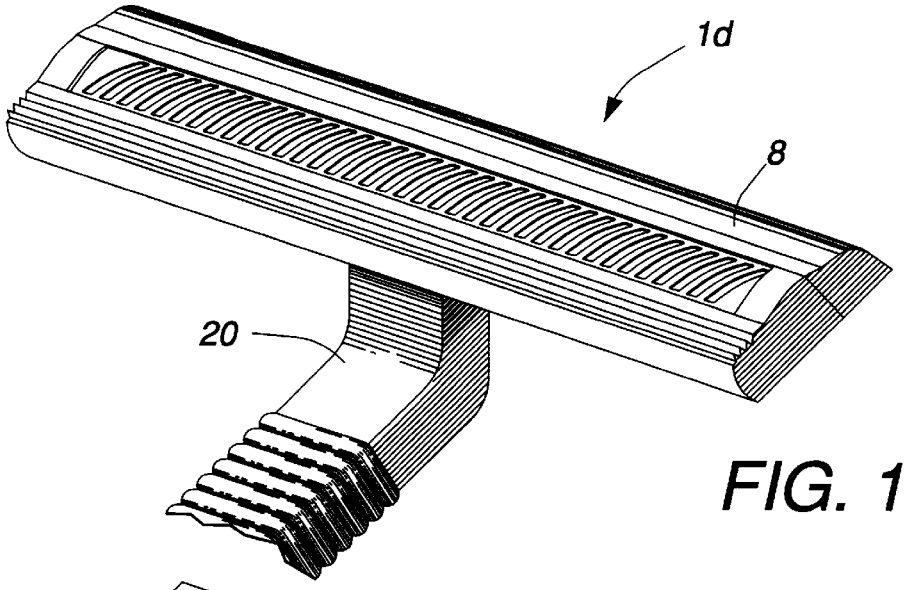
FIG. 12 is an perspective view of an assembled razor head with a foil unitary blade, according to the invention.
Figure 13:
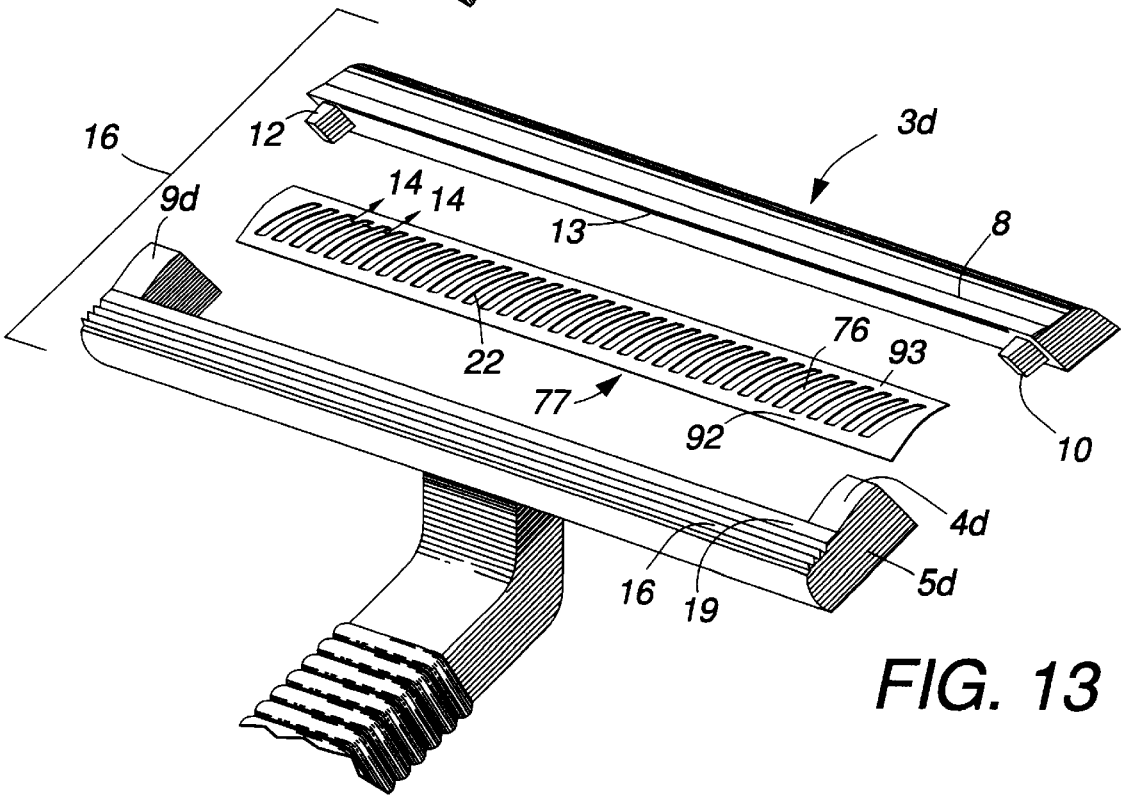
FIG. 13 is an exploded perspective view of the razor head assembly shown in FIG. 12.
Figure 14A:
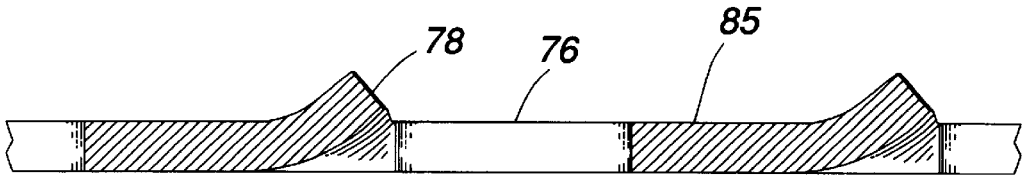
FIG. 14A is a cross section taken at 14—14 of FIG. 13, prior to grinding, according to an embodiment of the invention.
Figure 14B:
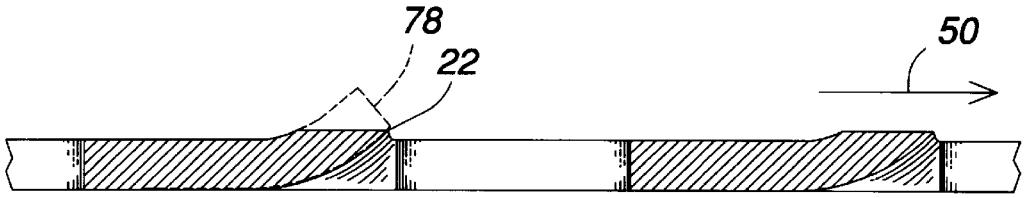
FIG. 14B is a cross section taken at 14—14 of FIG. 13, subsequent to grinding, according to an embodiment of the invention.
Figure 15A:
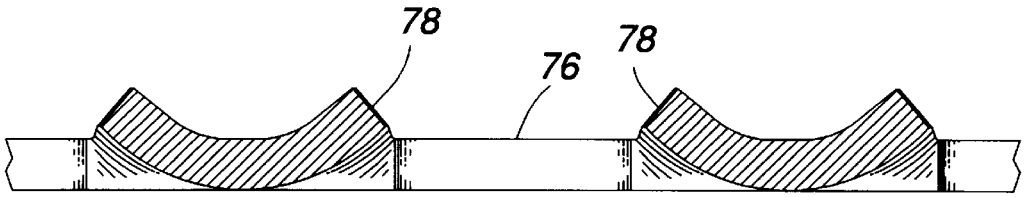
FIG. 15A is an alternative cross section to that shown in FIG. 14A.
Figure 15B:
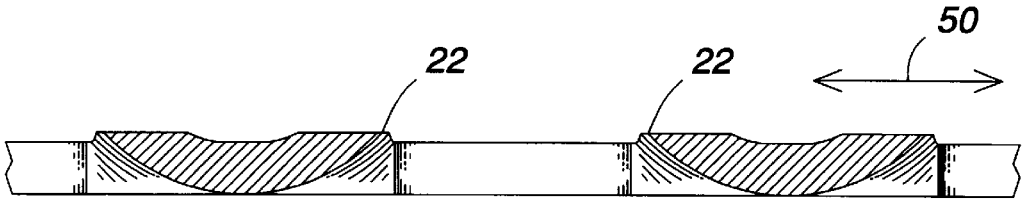
FIG. 15B is an alternative cross section to that shown in FIG. 14B.

In another embodiment of the unitary construction, shown in FIGS. 12 and 13, a strip of metal may be slotted to produce substantially rectangular slots 76, oriented at a high slicing angle, to produce a unitary foil blade 77. The unitary blade is supported by insertion into a locating slot 79 in the cap 3*d*, and into a similar locating slot (not shown) in the blade platform 5*d*, when the cap 3*d* is mated to the blade platform 5*d* by means of left and right locating posts 12, 10 into matching notches (not shown) in the blade platform 5*d*. At least one of the longer sides of the slots 76 serves as a cutting edge. This cutting edge may be due to the thinness of the strip, or the subsequent grinding of the strip surface. One method of grinding an edge 22 into the strip is shown in FIGS. 14A and 14B, where the edge of the slot 76 has been bent upwards, so that the raised slot edge 78 lies above the plane of the strip surface 85. Grinding the plane of the surface flat then removes the corner of the slot edge 78, and produces a cutting edge 22. In yet another embodiment, as shown in FIGS. 15A and 15B, both edges 78 of the slot 76 have been bent upwards and ground to produce cutting edges 22, resulting in a bidirectional blade. The blade may be used flat, or may be used with a positive curvature as shown in FIGS. 12 and 13. with an axis of curvature parallel to the width of the cutting zone. In this case, the leading flat 92 of the cutting edge 22 may rise above the leading guard 19, as the unslotted leading flat then serves the function of the guard 19. In the same way, the trailing flat 93 serves the function of the trailing guard 8.

While bi-directional blades have been discussed in the case of unitary foil blades, they may also be employed with other blade constructions, such as with monolithic unitary blades.

ASSEMBLED BLADES

While the embodiments that have been described have all been directed to unitary constructions, it is also possible to assemble discrete blades. While a razor comprising discrete blades is more difficult to assemble compared to unitary blades, it does have several points in its favor. First, conventional blade technology may be used. Second, the weight of the razor head is minimized. And third, by supporting the blades fore and aft, allowing the center section to be unobstructed, flow of debris is channeled between the blades directly to the rear of the razor head. While there are conventional razor heads that direct the flow of debris between the blades, none allow for a completely free and unobstructed passage.

Figure 16:
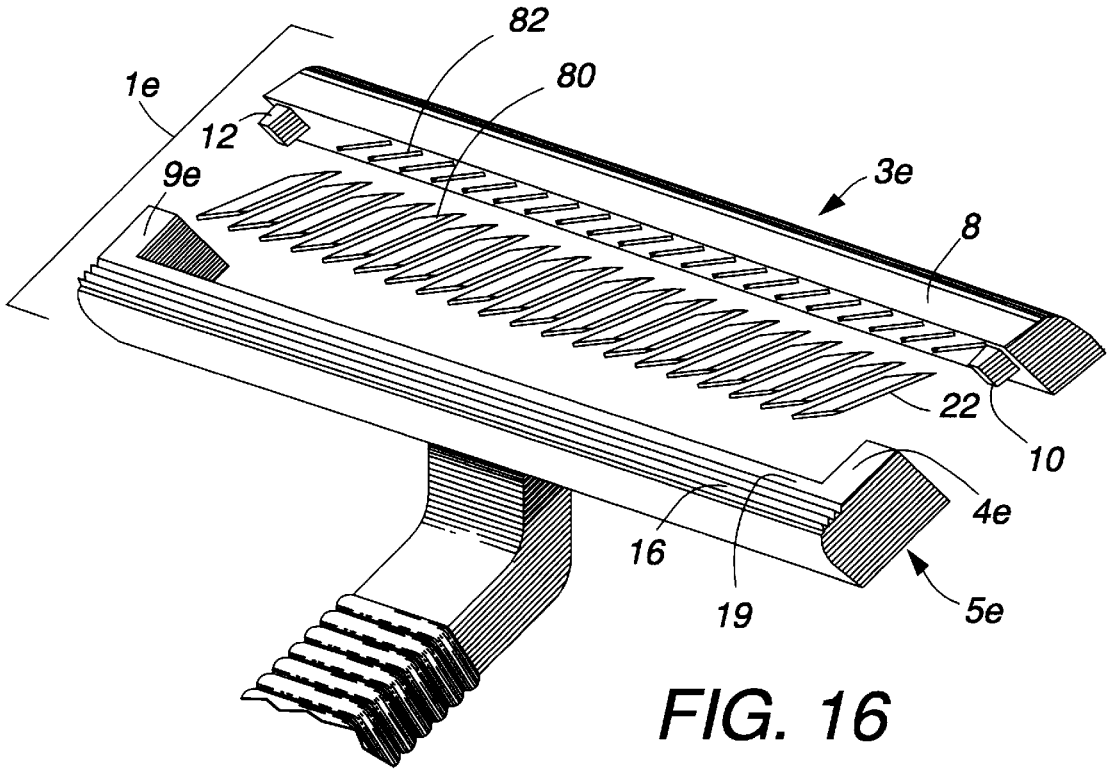
FIG. 16 is an exploded perspective view of a razor head of an another embodiment of the invention.

An embodiment of the invention wherein the cutting means are assembled is illustrated in FIG. 16, where the exploded razor head is generally indicated by the numeral 1*e*. The razor head 1*e* is shown to comprise a blade platform generally indicated by the numeral 5*e* a plurality of individual blades 80, and a cap 3*e*. The cap 3*e* comprises left and right locating posts 12, 10 which enter into matching receiving notches (not shown) in the blade platform 5*e*. The cap 3*e* has a trailing guard 8, which rises slightly above the cutting edges 22 of the individual blades 80 when assembled. Blade slots 82 in the cap 3*e*, in cooperation with blade slots (not shown) in the platform 5*e*, capture and support the blades 80 therebetween when the cap 3*e* and platform 5*e* are mated. There is no blade land, as in the case of the unitary blades previously described, so as to allow free passage of shaving debris between adjacent blades 80, exiting from the rear of the razor head 1*e*.

In FIG. 16, the blade platform 5*e* further comprises a leading guard 19 rising slightly above the level of the cutting edges 22 of the blades 80 when assembled and having skin tensioning means 16, a left flanking guard 9*e*, and a right flanking guard 4*e*. While skin tensioning means 16 have been illustrated in the several drawings as comprising triangular shaped riblets, any method of skin tensioning may be employed.

Figure 17:
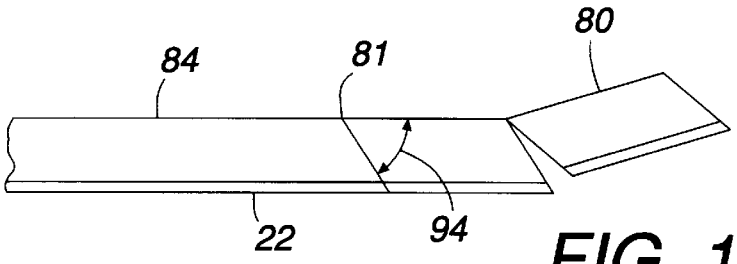
FIG. 17 is a top plan view of a razor strip being cut into segments.

In FIG. 17, the individual blades 80 are shown to be cut into a parallelogram shape from a continuous blade strip 84, with the angle 94 of the cut line 81 to the long axis of the strip 84, approximately equal to the slicing angle, so as to minimize the required depth of the slots 82.

While the invention has been described in connection with preferred embodiments, it is not intended to limit the scope of the invention to the particular form set forth, but on the contrary, it is intended to cover such alternatives, modifications, and equivalents as may be included within the spirit and scope of the invention as defined by the appended claims.

I claim:

1. A safety razor head assembly having a cutting zone having a width and a height, comprising spaced leading and trailing guard means, and a plurality of cutting edges disposed in the space between said leading and trailing guard means, said cutting edges fixed in a spaced relationship along the cutting zone width, said cutting edges having an effective cutting length and a slicing angle, where said effective cutting length is greater than about 1 mm and less than about 8 mm, and said slicing angle is greater than 30 degrees and less than about 85 degrees, and wherein said cutting edges comprise a slotted metal strip.

2. A safety razor head as recited in claim 1, wherein said plurality of cutting edges are of unitary construction, and wherein said unitary construction comprises a metal strip having substantially rectangular slots.

3. A safety razor head assembly having a cutting zone having a width and a height, comprising spaced leading and trailing guard means, and a plurality of cutting edges disposed in the space between said leading and trailing guard means, said cutting edges fixed in a spaced relationship along the cutting zone width, said cutting edges interrupted by a plurality of projections, so that said cutting edges between said projections have an effective cutting length and a slicing angle, where said effective cutting length is greater than about 1 mm and less than about 8 mm, and said slicing angle is greater than 30 degrees and less than about 85 degrees.

4. A razor head assembly as set forth in claim 3, further comprising at least one flanking guard.

5. A razor head assembly as set forth in claim 3, wherein said cutting edges are formed of stainless steel.

6. A razor head assembly as set forth in claim 3, wherein said cutting edges are formed of ceramic.

7. A razor head assembly as set forth in claim 3, wherein said cutting edges comprise a metal strip having substantially rectangular slots.

* * * * *